US008225806B1

(12) United States Patent
Simonelli

(10) Patent No.: US 8,225,806 B1
(45) Date of Patent: Jul. 24, 2012

(54) UMBRELLA HAVING DEPLOYMENT RETAINERS

(76) Inventor: Anthony F. Simonelli, Warwick, RI (US)

( * ) Notice: Subject to any disclaimer, the term of this patent is extended or adjusted under 35 U.S.C. 154(b) by 58 days.

(21) Appl. No.: 12/726,256

(22) Filed: Mar. 17, 2010

Related U.S. Application Data

(60) Provisional application No. 61/214,108, filed on Apr. 20, 2009.

(51) Int. Cl.
*A45B 19/00* (2006.01)
*A45B 25/24* (2006.01)
*A45B 25/02* (2006.01)

(52) U.S. Cl. ..... 135/27; 135/19.5; 135/34.2

(58) Field of Classification Search ..... 135/16, 135/19.5, 27, 34.2
See application file for complete search history.

(56) References Cited

U.S. PATENT DOCUMENTS

| | | | | |
|---|---|---|---|---|
| 167,070 | A | | 8/1875 | Colby et al. |
| 558,867 | A | | 4/1896 | Waples, Jr. |
| 629,460 | A | | 7/1899 | Nagell |
| 139,281 | A | | 8/1920 | King |
| 3,435,836 | A | | 4/1969 | Vanzini |
| 3,534,752 | A | * | 10/1970 | Vanzini ..... 135/22 |
| 3,709,238 | A | * | 1/1973 | Leopoldi et al. ..... 135/15.1 |
| 3,844,301 | A | * | 10/1974 | Harrell ..... 135/15.1 |
| 4,084,600 | A | | 4/1978 | dePolo |
| 4,522,300 | A | * | 6/1985 | Hamblet ..... 206/315.4 |
| 4,821,756 | A | | 4/1989 | England |
| 4,842,003 | A | | 6/1989 | Baldwin et al. |
| 4,934,394 | A | | 6/1990 | Hermanson |
| 4,966,179 | A | * | 10/1990 | Baldwin et al. ..... 135/19.5 |
| 5,188,137 | A | | 2/1993 | Simonelli |
| 5,285,803 | A | * | 2/1994 | Baldwin et al. ..... 135/19.5 |
| 5,477,431 | A | * | 12/1995 | Curameng, Jr. ..... 362/102 |
| 5,690,131 | A | * | 11/1997 | Voigt ..... 135/19.5 |
| 6,273,111 | B1 | * | 8/2001 | Weiss et al. ..... 135/25.41 |
| 7,556,053 | B2 | * | 7/2009 | Hansen ..... 135/114 |
| 2009/0223545 | A1 | * | 9/2009 | Beyer et al. ..... 135/31 |

FOREIGN PATENT DOCUMENTS

| | | |
|---|---|---|
| FR | 1.429.394 | 1/1966 |

* cited by examiner

*Primary Examiner* — David Dunn
*Assistant Examiner* — Danielle Jackson
(74) *Attorney, Agent, or Firm* — Michael I. Kroll

(57) ABSTRACT

An umbrella having housing with a deployable canopy extendable and retractable therefrom. The canopy comprises a material covering supported by flexible ribs and rib extension retainer cords. The umbrella further provides an adjustable strap extending between the exterior distal ends and a handle on one distal end of a flexible collapsible material. The adjustable strap further provides a D-ring and clasp on one end allowing for removal of said strap.

10 Claims, 8 Drawing Sheets

UMBRELLA HAVING DEPLOYMENT RETAINERS

RELATED APPLICATIONS

This application is subject to US provisional application Ser. No. 61/214,108 filed 20 Apr. 2009.

Please incorporate by reference all information in said provisional applications into this instant invention.

BACKGROUND OF THE INVENTION

1. Field of the Invention

The present invention relates generally to umbrellas and, more specifically, to an umbrella having housing with a deployable canopy extendable and retractable therefrom. The canopy comprises a material covering supported by flexible ribs and rib extension retainers. The umbrella further provides an adjustable strap extending between the exterior distal ends and a handle on one distal end of a flexible collapsible material. The adjustable strap further provides a D-ring and clasp on one end allowing for removal of said strap.

2. Description of the Prior Art

There are other tubular devices designed for umbrellas. Typical of these is U.S. Pat. No. 5,188,137 issued to Simonelli on Feb. 23, 1993.

While this umbrella may be suitable for the purposes for which it was designed, it would not be as suitable for the purposes of the present invention, as hereinafter described.

SUMMARY OF THE PRESENT INVENTION

The benefits that are described here would be most beneficial to an umbrella: that consists of an elongated housing having an open top. A collapsible canopy is carried on the elongated housing. A mechanism is for operating the canopy so that when the canopy is placed in a closed position it will be stored within the open top of the elongated housing and when the canopy is placed in the opened position the canopy will extend outwardly form the open top over the elongated housing hereinafter referred to as the umbrella.

The first benefit is the process for further stabilizing the canopy, during use of the umbrella on windy days. The second benefit is the addition of a multi-purpose, adjustable, and removable strap. The third benefit is a collapsible carrying handle, also used when opening the umbrella. The benefits are canopy stabilization, adjustable strap and, collapsible carrying handle.

The first significant improvement to this type of umbrella is a means to further stabilize the canopy. It has been observed that when using the umbrella in windy weather the canopy has a tendency to rise up a few inches. A mechanism has been designed to give the canopy added stability in that type of weather. The process used consist of cords of selected strong material, such as nylon braided cord, and a spacer that is placed close to the base where the ribs are attached.

The cords need to be of a precise length, and strategically attached to the inside open top of the elongated housing, and the other end of the cords attached to the fabric canopy preferably close to the ribs.

When the canopy is opened the attached cords will be pulled out of the top of the shaft. In the full opened position; the cords place a tension on the canopy because of their length and the position of attachment to the canopy. This will actually further form the shape of the canopy, but more importantly enable the canopy to be more stable when wind passes over or under the canopy. When the umbrella is closed the cords will be pulled inside the elongated housing because of their attachment to the canopy.

The cords need to be of such a length that they will be pulled completely inside the housing, but not so short that they will put excessive tension on the canopy when closed. When considering the following two characteristics for the purpose of manufacturing: "Simplicity of operation when opening and closing the umbrella, and also using a minimum amount of material" arrangement of the cords for an umbrella having eight ribs would be as follows: A cord used for this purpose would be "Y" shaped . . . . The single end is secured to the inside of the open top of the elongated housing between two of the ribs . . . . The other two ends of the cord will be secured to the canopy next to the rib so that the tension would be most effective. This process is repeated for the remaining number of ribs. The same process could be used for an umbrella having an odd number of ribs with the exception that one cord would be single and not "Y" shaped.

The other part of the canopy stabilization process is accomplished by the placement of a device such as a spacer; for holding the ribs apart at a point near the base member where the ribs attach. It was discovered that the ribs are pushed together at this point when a force is placed in the opposite direction of the full open canopy; such as wind lifting the canopy. Although the distance is small at the base it is multiplied as it extends along the length of the rib. An illustration of this would be the distance that a windshield wiper moves as it sweeps across a windshield. At the pivot point it may only travel 1 inch. This would equate to 10 inches of travel if measured at a point further outwardly along the wiper blade. In the case of this umbrella it was found that a spacer placed on the center rod near the base of the ribs reduced canopy movement and gives the canopy a more rigid feel especially when air pressure would cause it to lift up.

The second improvement to the umbrella is the addition of a multipurpose, adjustable, and removable strap. The strap could be adjusted to different lengths for varying applications. The longer length would be used for carrying the umbrella over ones shoulder. This is beneficial when the umbrella is not in use but still needs to be carried such as walking inside a mall. Because the umbrella is being carried over ones shoulder it would free-up that one hand normally used just for the purpose of carrying the needed umbrella.

The strap could easily be adjusted to its shortest length. At this length the umbrella could be carried along with another object in the same hand; such as with a briefcase, handbag, or computer case. Another function of this strap is the ability to place the umbrella over the extended handle of a suitcase like the ones on roller wheels that are pulled behind a person. This strap is also completely removable if so desired and small enough to be stored in a persons pocket or purse. This umbrella strap consists of a hooking devise on one end a snap or other fastening method at the other end. It also has snap bases at varying points along the strap for pre-positioned adjusting points . . . . A piece of stretch material is sewn at a central position along one side of the strap. It is added for the purpose of placing the umbrella over a suitcase handle . . . .

In order to support this type of strap, an umbrella would need two attaching points. The umbrella shown here has a ring fixed to the top of the elongated housing. The other end of the umbrella has double "D" rings installed . . . .

Removal of the strap "if desired" is as follows: Step A. Unsnap it. Step B. Pull the strap through the double "D" rings. Step C. Un-hook the other end from the single ring. Installation would be to reverse the order of steps Step C, B, A.

Two methods for adjusting the strap offered. One is fixed positions, and the other is variable positions. The fixed positions are accomplished with the use of the snaps, while the variable positions are accomplished with the use of the double "D" ring configuration.

Fixed positions are accomplished with the placement of snap bases along the strap. Two are offered for this application. The snap receptacle is on the end of the strap. In order to use the fixed positions the strap is pulled through the double "D" rings, and over the top of both rings. The strap length is changed depending on which snap base is used.

Variable positions can be accomplished with the use of the double "D" ring configuration offered. This is accomplished by utilizing the double "D" rings in the same manner that they would be used for when adjusting a motorcycle helmet strap. With this option the strap length could be adjusted for any clothing arrangement or personal preference.

The third improvement is the addition of a collapsible carrying handle. One benefit of this type handle is the ability to shorten the overall length of the umbrella by several inches. Another is; added cushion for the palm of ones hand; used when closing this type of umbrella. Another benefit would be an alternate location for the placement of the double "D" rings.

This handle is also used for hanging the umbrella in traditional places where other umbrellas' are stored. The handle is made of flexible material that is able to collapse with minimum pressure, an example would be a nylon or leather strap. It is fastened to opposite sides at the bottom of the shaft. This offers a wider opening to grasp the umbrella A primary object of the present invention is to provide an extendable retractable umbrella from a housing forming umbrella.

Another object of the present invention is to provide the umbrella with an adjustable strap extending between the umbrella distal ends that can be looped over a wheeled carrier handle.

Yet another object of the present invention is to provide the umbrella with an adjustable strap that can be looped over a user's shoulder.

Still yet another object of the present invention is to provide the umbrella with a handle positioned on one end of said umbrella with said handle made of flexible material that is able to collapse with minimum pressure, such as, a nylon or leather strap.

Another object of the present invention is to provide the umbrella with rib deployment retainers consisting of cords of selected strong material, such as nylon braided cord.

Yet another object of the present invention is to provide the umbrella with a spacer that is placed close to the base where the ribs are attached.

Additional objects of the present invention will appear as the description proceeds.

The present invention overcomes the shortcomings of the prior art by providing an umbrella having a housing forming with a deployable canopy extendable and retractable therefrom. The canopy comprises a material covering supported by flexible ribs and rib extension retainers. The umbrella further provides an adjustable strap extending between the exterior distal ends and a handle on one distal end of a flexible collapsible material. The adjustable strap further provides a D-ring and clasp on one end allowing for removal of said strap.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
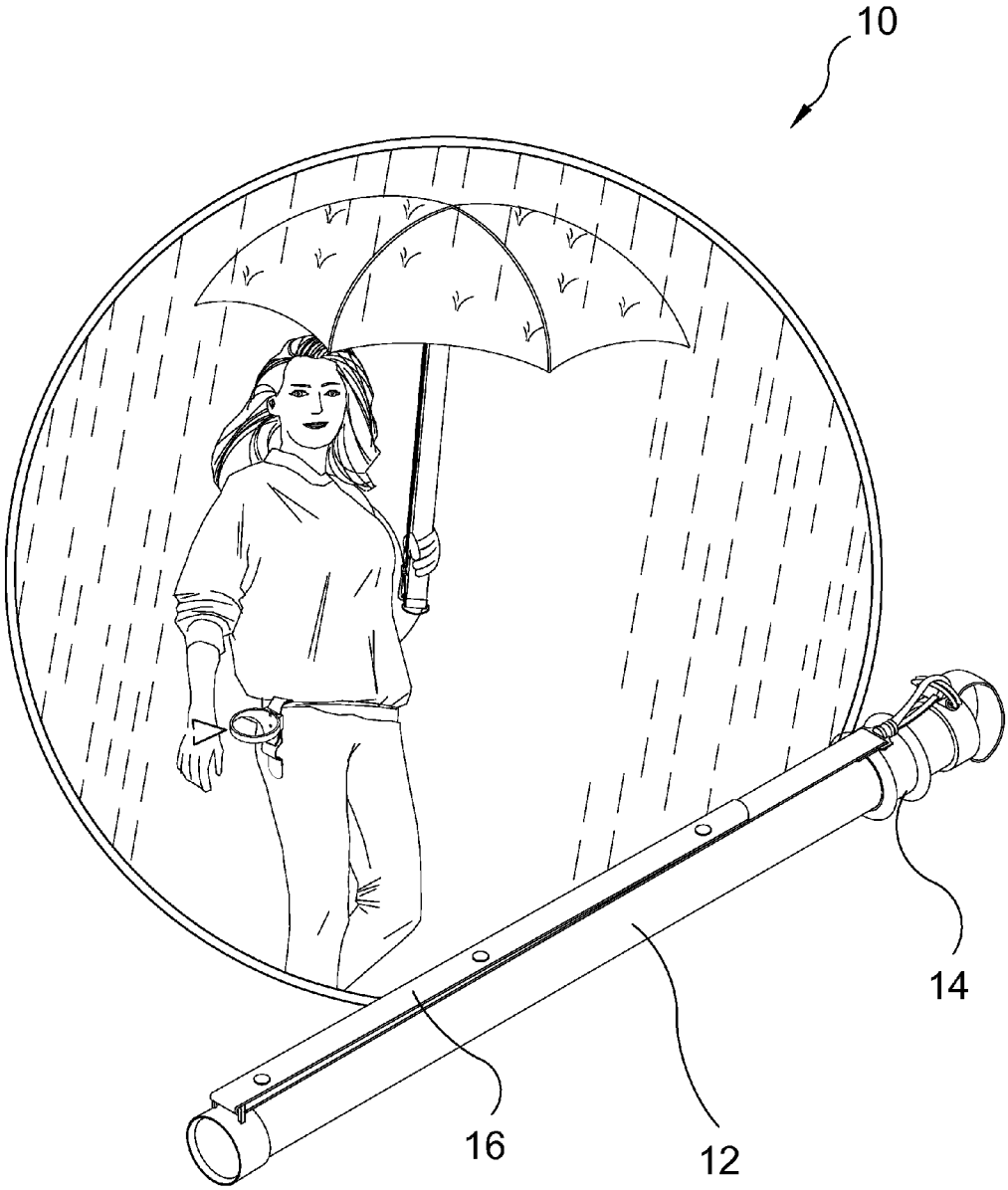
FIG. 1 is an illustrative view of the present invention in use.

Turning now descriptively to the drawings, in which similar reference characters denote similar elements throughout the several views, the figures illustrate the Extendible/Retractable Umbrella of the present invention. With regard to the reference numerals used, the following numbering is used throughout the various drawing figures.

10 Extendible/Retractable Umbrella of the present invention
12 housing
14 push sleeve
16 adjustable removable strap
18 open end of 12
20 closed bottom end of 12
24 clip
26 double "D" ring
28 attachment ring
30 snap element
32 flexible loop
34 center support shaft
36 canopy
38 flexible rib
40 retaining cord
42 hooked end of 38
46 base member
48 connecter arms
50 slotted groove
52 elastisized section of 16
54 diverging ends of 40
56 divergence cord
58 divergence cord linkage ring
60 spacer element.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the retractable, extendible umbrella 10 of the present invention in use. Shown is the present invention comprising an umbrella having a structure whereby it may be fully self contained within a hollow cylindrical housing 12 and expediently deployed though a simple sliding action of moving a push sleeve 14 from the bottom of the housing 12 to the top portion thereof. Further provided is an adjustable strap 16 extending from the distal ends of said housing 12.

Figure 2:
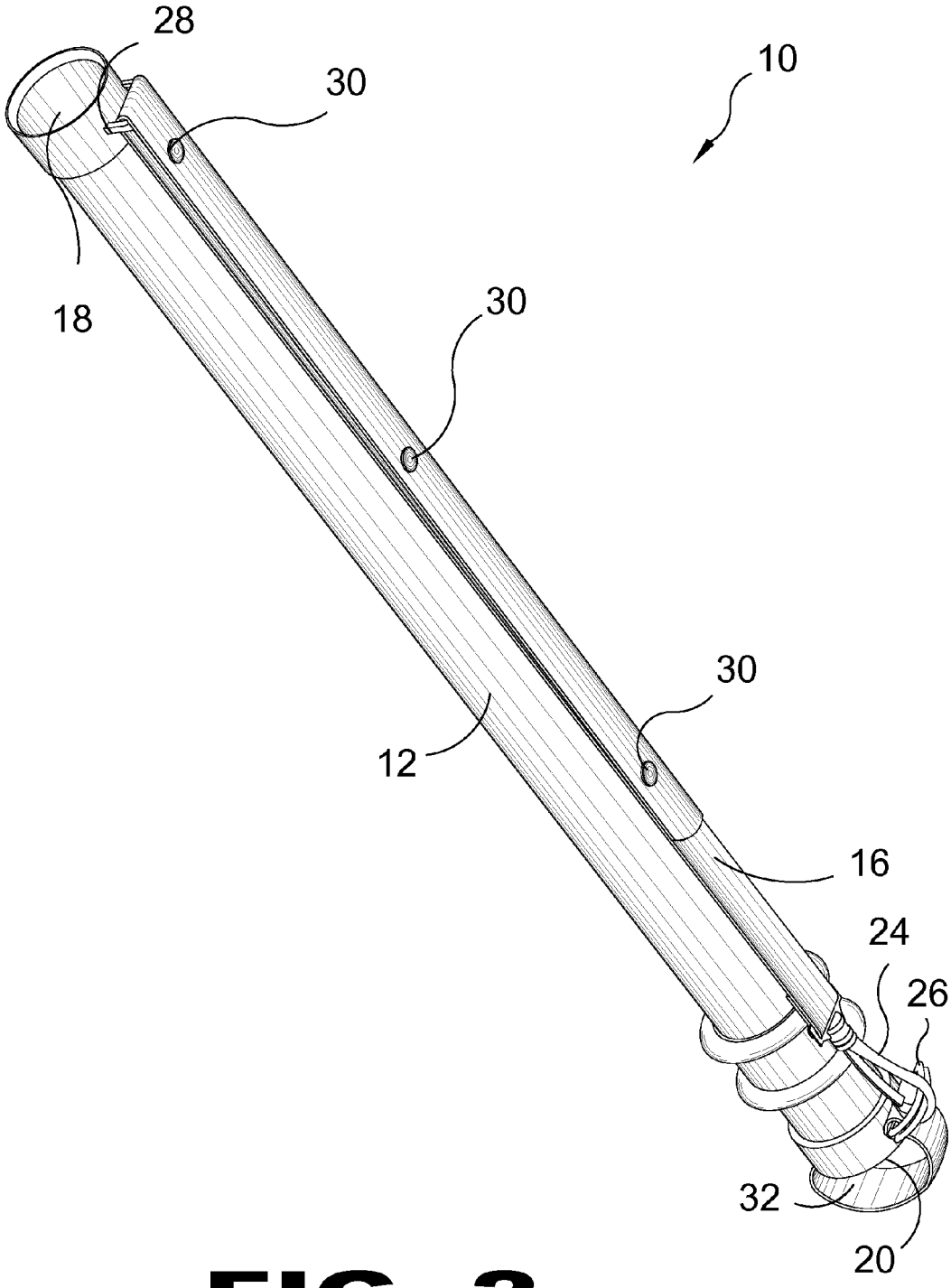
FIG. 2 is an illustrative view of the present invention.

FIG. 2 is an illustrative view of the extendable, retractable umbrella 10 of the present invention comprising an elongate, cylindrical housing 12 having an open top end 18 and a closed bottom end 20, a multipurpose, adjustable and removable strap member 16 having one end with a clip 24 that attaches to a double "D" ring 26 on the housing 12 with the other end looped through an attachment ring 28 disposed on the opposing end of the housing 12. Also provided are a plurality of snap elements 30 spaced along the strap 16 for adjusting the length thereof.

Figure 3:
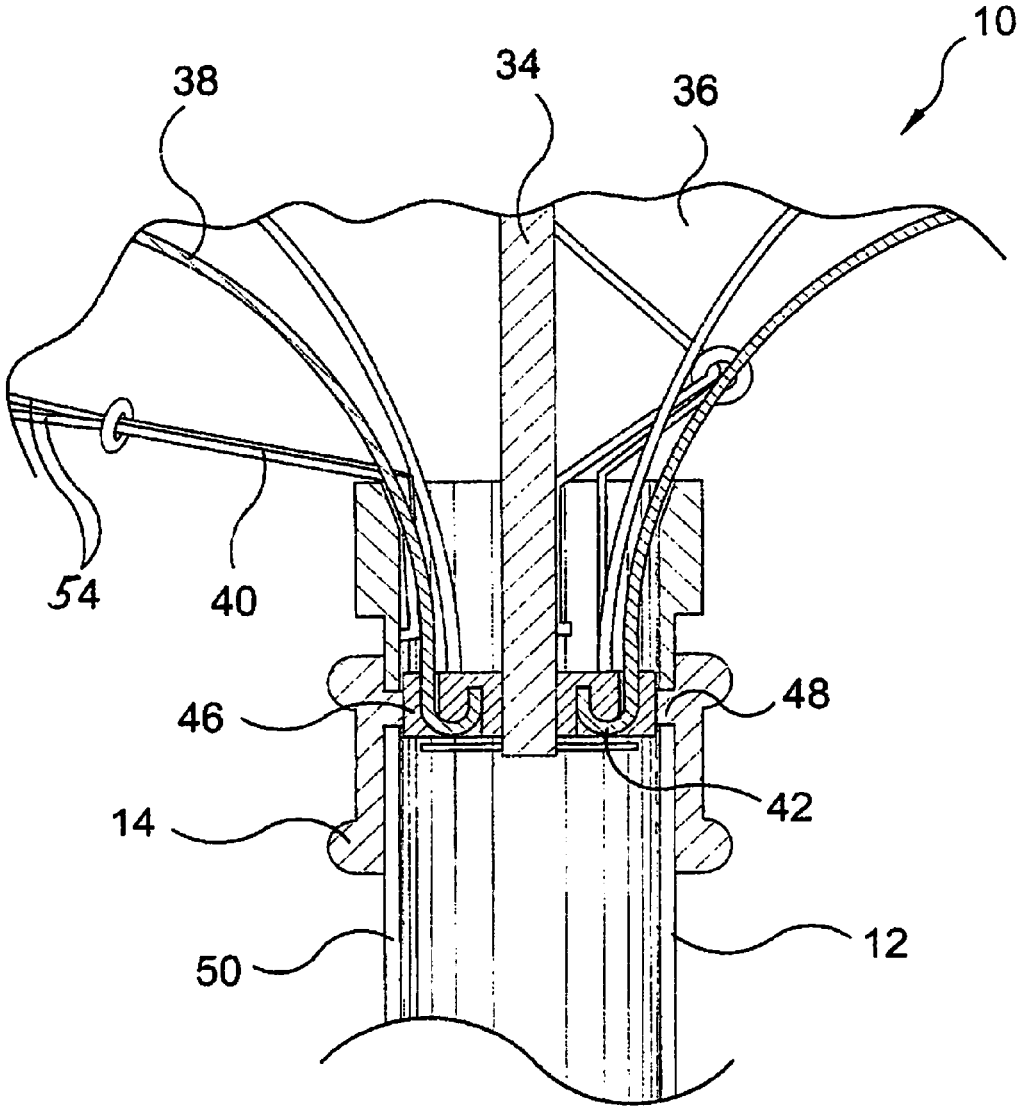
FIG. 3 is a sectional view of the present invention deployed.

FIG. 3 is a sectional view of the present invention deployed. Depicted is the internal functioning of the linkage and supporting structures of the umbrella 10 as they are pushed out of the housing 12. The canopy 36 is supported by flexible ribs 38 and a plurality of pliable rib extension retainer cords 40 terminating in a pair of divergent retainers. The hooked ends 42 of the flexible ribs 38 are secured to a base member 46. The push sleeve 14 communicates with base member 46 with a pair of connector arms 48 extending through opposing longitudinal slotted grooves 50 in the housing 12.

Figure 4:
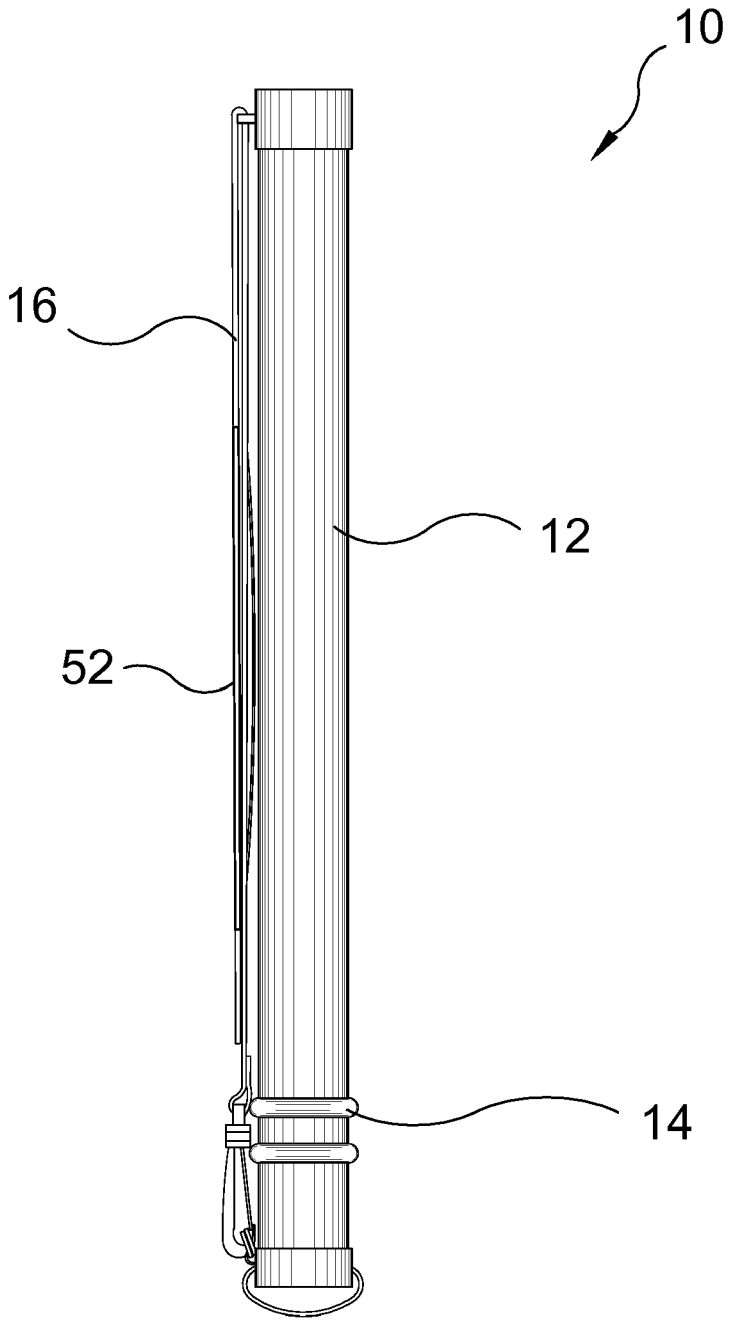
FIG. 4 is a side view of the umbrella of the present invention.

FIG. 4 is a side view of the umbrella 10 of the present invention. Shown is a side view of the umbrella 10 with the push sleeve 14 lowered and the umbrella completely retracted into its cylindrical housing 12. Also shown is the exterior adjustable strap 16 having a centrally positioned elasticized section 52 incorporated therein for ease in carrying or placing over the handle of roller luggage and the like . . . .

Figure 5:
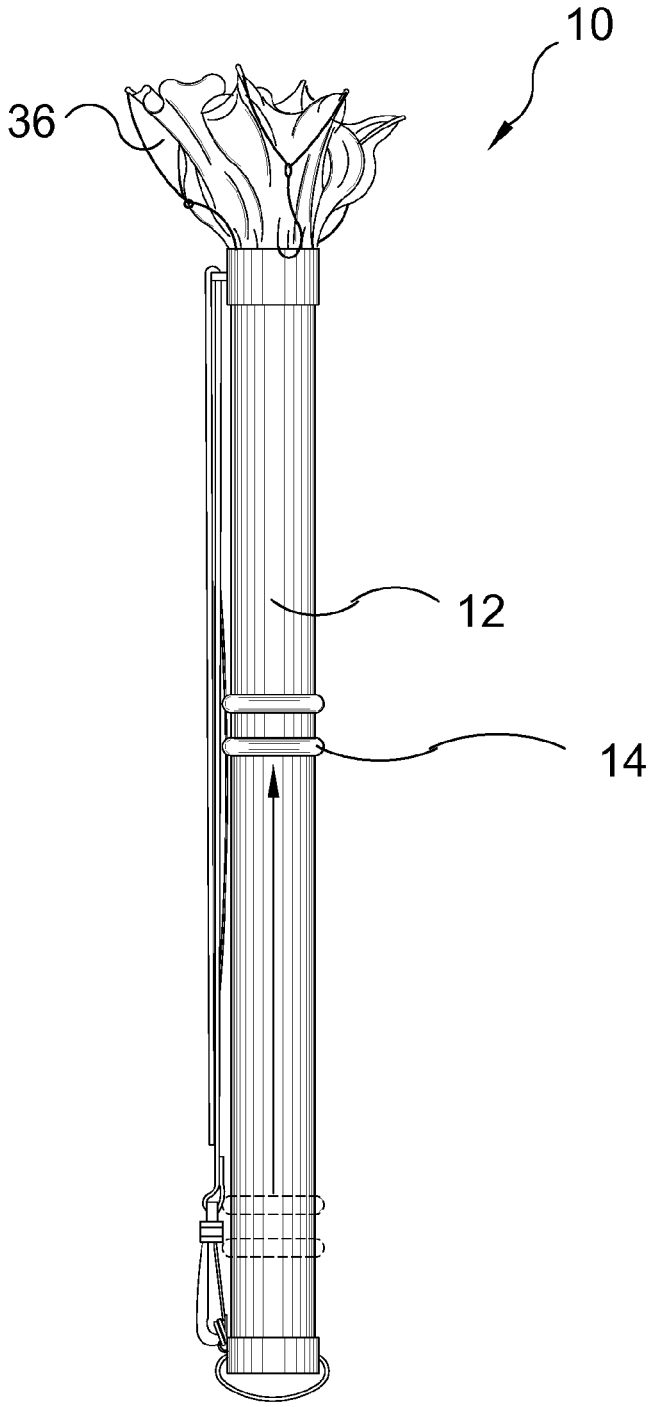
FIG. 5 is a side view of the umbrella of the present invention.

FIG. 5 is a side view of the umbrella 10 of the present invention. Shown is a side view with the canopy 36 and related support components partially deployed from its cylindrical housing 12 due to the urging of the upward movement of the push sleeve 14.

Figure 6:
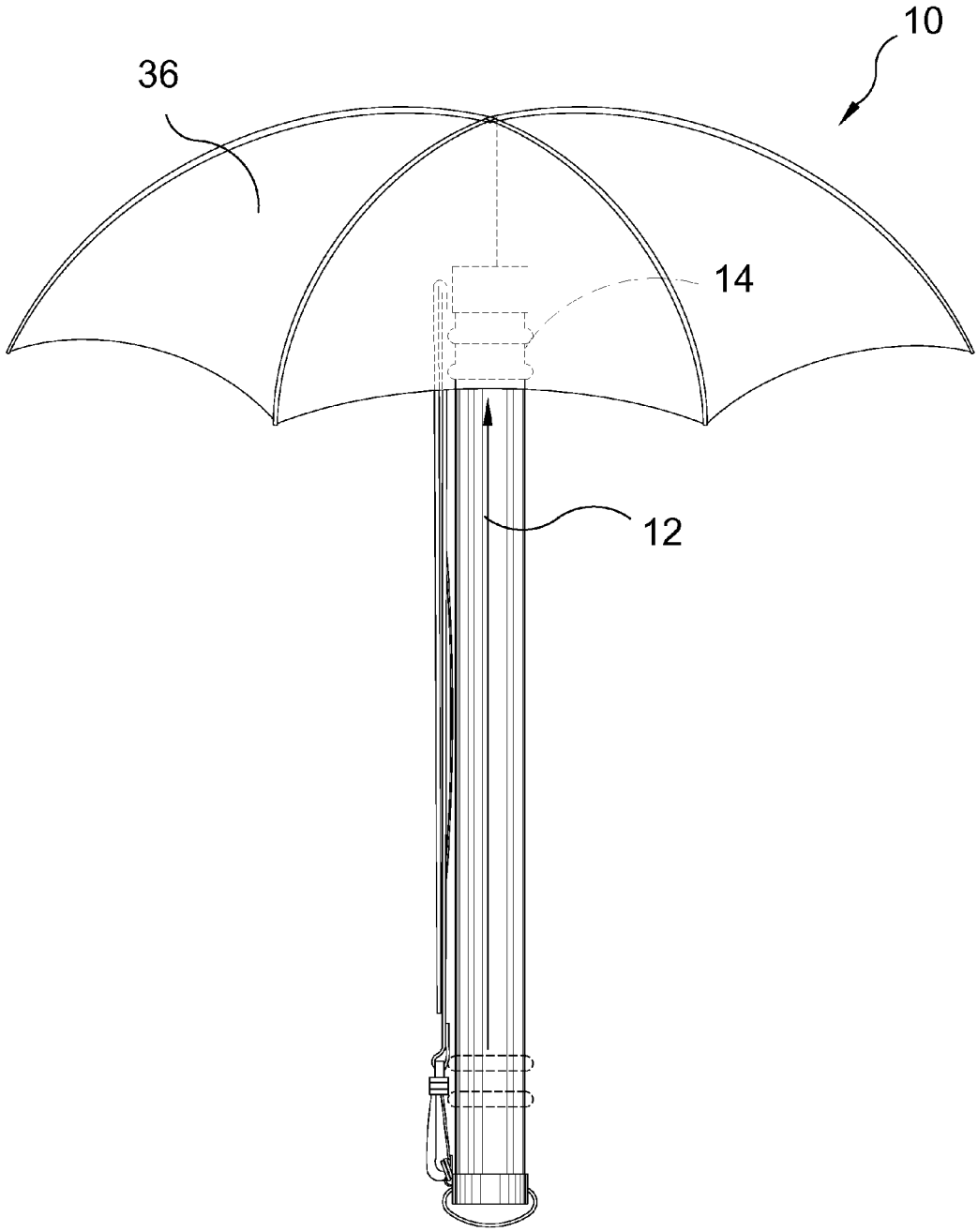
FIG. 6 is a side view of the umbrella of the present invention.

FIG. 6 is a side view of the umbrella 10 of the present invention. Shown is a side view of the umbrella 10 with the push sleeve 14 in the fully raised position on the housing 12 and the canopy 36 deployed and ready for use.

Figure 7:
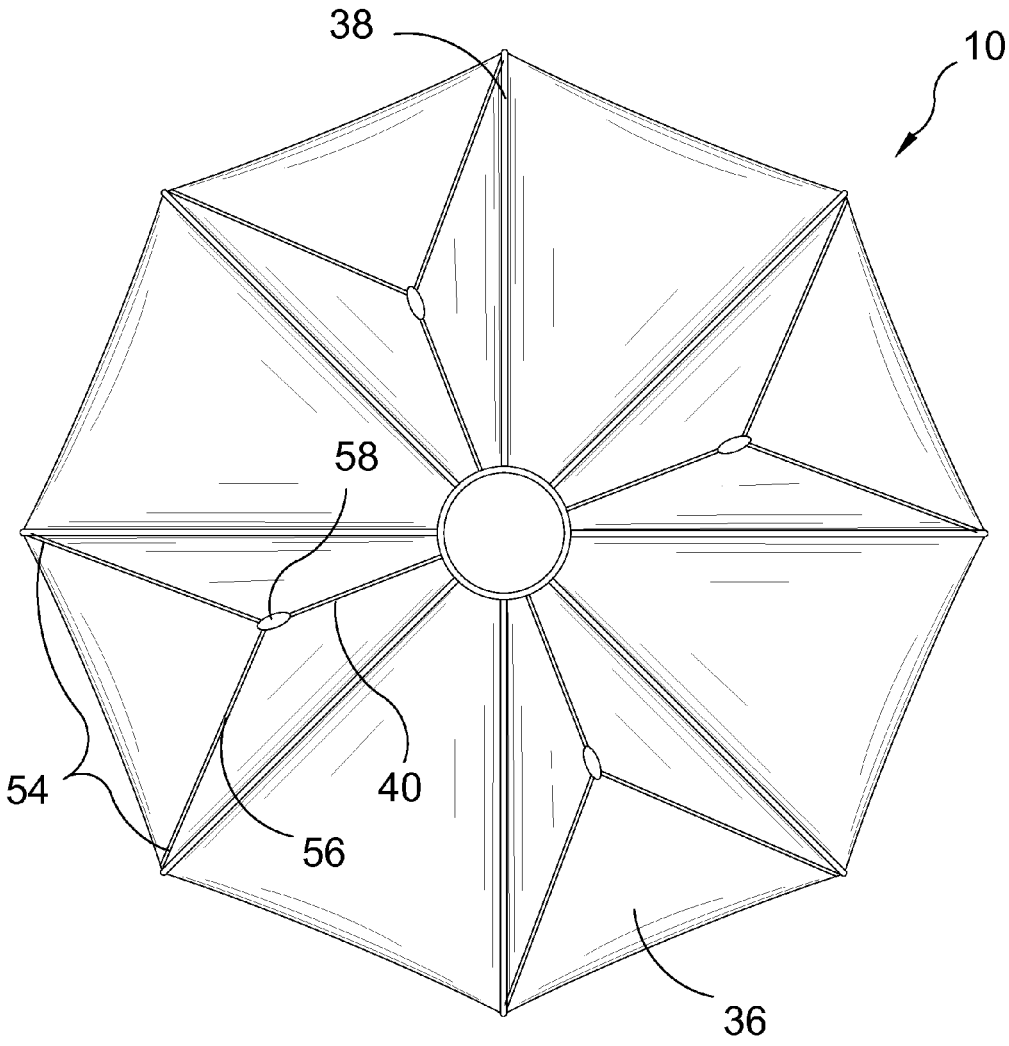
FIG. 7 is an inside bottom view of the umbrella of the present invention deployed.

FIG. 7 is an inside bottom view of the umbrella 10 of the present invention deployed. Shown is the underside of the canopy 36 having flexible ribs 38 and rib extension retainer cords 40 that prevent high winds from deforming the canopy 36. The extension retainer cords 40 comprise a single cord having diverging ends 54 fastened to the canopy 36 proximal to the peripheral attachments points of their respective adjacent flexible ribs 38. The configuration demonstrated here utilizes a separate divergent cord 56 centrally connected to the retaining cord 40 via a ringed divergent cord linkage 58.

Figure 8:
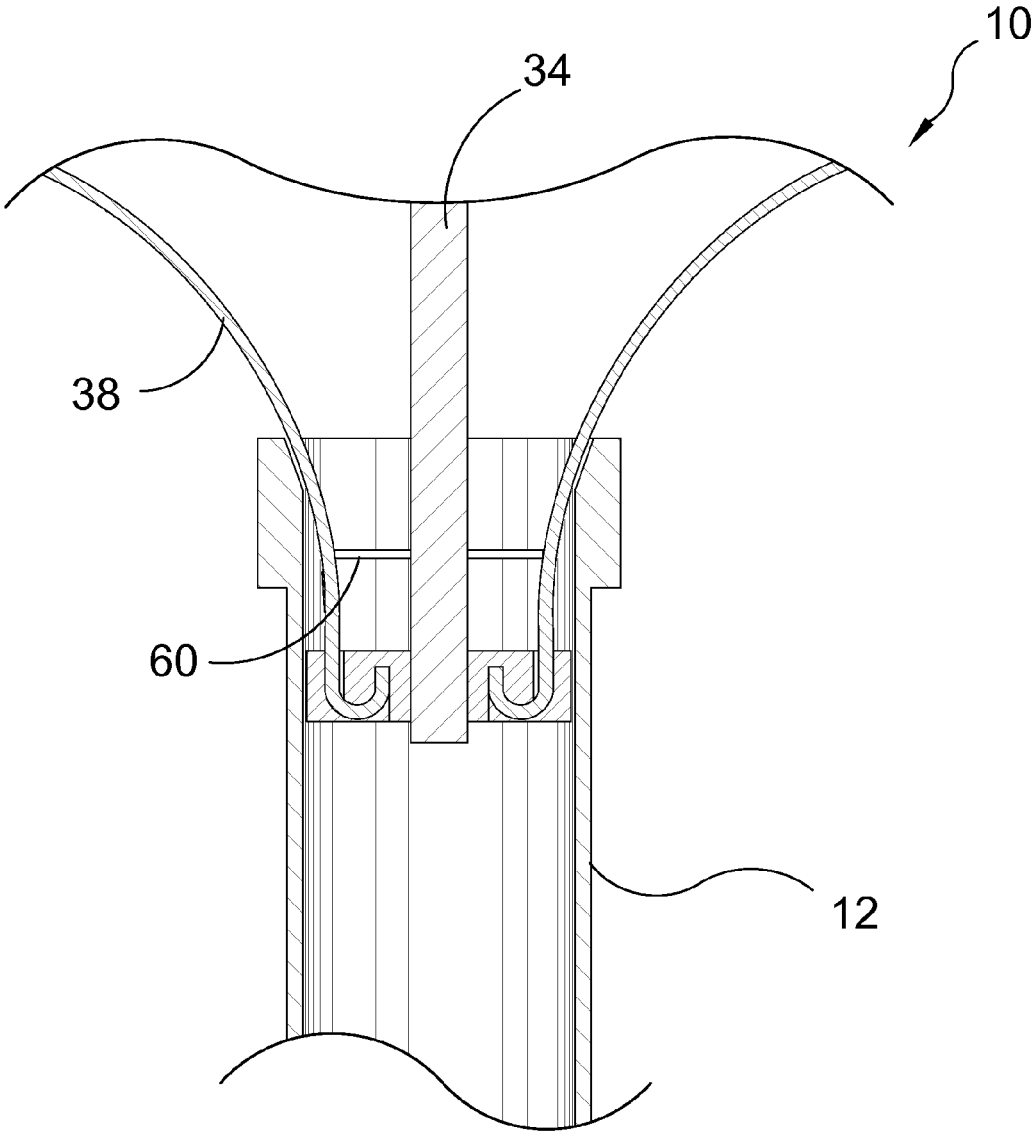
FIG. 8 is a sectional view of the umbrella of the present invention.

FIG. 8 is a sectional view of the umbrella 10 of the present invention. Shown is a spacer 60 circumscribing the center support shaft 34 to keep the plurality of flexible ribs 38 spaced apart within the housing 12.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An extendable, retractable umbrella comprising:

a) a substantially cylindrical housing having a closed bottom end, an open top end and a pair of opposing longitudinal slotted grooves extending therethrough;

b) an extendable center support shaft slidably disposed within said housing;

c) a plurality of flexible rib members secured to a slidable base member on said support shaft;

d) a collapsible canopy having an underside with a central portion thereof secured to the top end of said support shaft and the peripheral edges fastened to the distal ends of said flexible rib members;

e) a plurality of rib deployment retaining cords having a first proximal end attached to the top interior wall of said housing and a second distal end secured to said canopy proximal said flexible rib members, wherein each of said retaining cords has divergent distal ends with each end fastened proximal to adjacent flexible rib members, and wherein said divergent distal ends comprise a separate divergent cord connected to one of said retaining cords with a ringed cord linkage; and f) means for extending and retracting said support shaft, said canopy, said flexible rib members and said retaining cords within said housing.

2. The retractable, extendable umbrella according to claim 1, wherein said slidable base member is disposed at the bottom end of said support shaft and secured thereto.

3. The retractable, extendable umbrella according to claim 2, wherein said proximal ends of said flexible rib members have a hooked configuration.

4. The retractable, extendable umbrella according to claim 2, wherein said extension and retraction means comprises a slidable push sleeve encompassing the exterior wall of said housing and having a pair of opposing connection arms extending through said opposing slotted grooves and communicating with said base member.

5. The retractable, extendable umbrella according to claim 1, further comprising a multipurpose, adjustable, and removable strap.

6. The retractable, extendable umbrella according to claim 5, wherein said strap is removably fastened to opposing ends of said housing with one end utilizing a clip snapped onto a double "D" ring and the other with an attachment ring.

7. The retractable, extendable umbrella according to claim 6, wherein the length of said strap is adjustable via a plurality of spaced apart snap elements.

8. The retractable, extendable umbrella according to claim 7, wherein said strap has a centrally located elasticized section sewn therein for ease in carrying and hanging onto an object.

9. The retractable, extendable umbrella according to claim 1, wherein said closed end of said housing includes a flexible loop for suspending said umbrella from an object.

10. The retractable, extendable umbrella according to claim 1, further including a spacer element circumscribing said center support shaft to maintain said flexible ribs in a spaced apart relation within said housing.

* * * * *